United States Patent [19]

Darda et al.

[11] Patent Number: 4,683,986

[45] Date of Patent: Aug. 4, 1987

[54] SPRING DRIVE FOR TOY VEHICLES

[76] Inventors: Helmut Darda, Im Tal, 7712 Blumberg; Reinhold Schoch, Schlangenbühl 6, D-7230 Schramberg, both of Fed. Rep. of Germany

[21] Appl. No.: 695,071

[22] Filed: Jan. 25, 1985

[30] Foreign Application Priority Data

Jan. 31, 1984 [DE] Fed. Rep. of Germany ..... 3403296

[51] Int. Cl.[4] ..... F03G 1/00; F16H 5/08

[52] U.S. Cl. ..... 185/39; 185/DIG. 1; 446/464; 74/812

[58] Field of Search ..... 185/37, 39, DIG. 1; 446/464; 74/812

[56] References Cited

U.S. PATENT DOCUMENTS

| | | | |
|---|---|---|---|
| 3,812,933 | 5/1974 | Darda | 185/37 |
| 4,053,029 | 10/1977 | Darda | 185/39 |
| 4,516,954 | 5/1985 | Chow et al. | 446/464 |
| 4,541,815 | 9/1985 | Lee et al. | 446/464 |

FOREIGN PATENT DOCUMENTS

| | | | |
|---|---|---|---|
| 2105734 | 8/1972 | Fed. Rep. of Germany | 446/464 |

*Primary Examiner*—Allan D. Herrmann
*Assistant Examiner*—Martin G. Belisario
*Attorney, Agent, or Firm*—Irvin A. Lavine

[57] ABSTRACT

A spring drive mechanism has a spiral spring positioned in a spring encasement as a power source. Its ends are connected, on the one hand, to a spring encasement gear and, on the other hand, to a spring shaft gear. For the purpose of winding up the spring, the spring encasement gear is in mesh with a first drive pinion and the spring shaft gear is in mesh with a second drive pinion. These drive pinions has a stress-free connection to a wind down/wind up shaft across a unidirectional torque transmitters which each permits rotation in one direction; the directions being opposite. A reverse pinion has one pinion sprocket is mesh with the spring shaft gear. The other pinion sprocket is in mesh with the drive pinion in the wind up position. In this position, the spring drive mechanism is blocked in such a way that the tensioned driving spring cannot release. In order to maintain the reverse pinion in this position without any use of external force, an engaging lever is provided and is constructed in such a way that the blocking is released when the wind down/wind up shaft is turned counterclockwise.

9 Claims, 9 Drawing Figures

SPRING DRIVE FOR TOY VEHICLES

BACKGROUND OF THE INVENTION

The present invention pertains to a spring drive for toy vehicles.

A spring drive of the type herein disclosed is known from Darda U.S. Pat. No. 4,053,029. In that type of spring drive, the driving spring is tensioned by rotating the wind down/wind up shaft which carries wheels of the toy vehicle. In this connection, two gears which are connected to each other by means of a reverse pinion are placed in the force transmitting path between the wind down/wind up shaft, on the one hand, and the ends of the driving spring, on the other hand. The construction is such that by winding the wind down/wind up shaft in either direction the driving spring is tensioned both from its interior and external ends. Should the reverse pinion be held in mesh with both gears, the transmission is blocked and the driving gear cannot release. Only upon release of the reverse pinion axle, for example by releasing a holding force from the chassis, is transmission blockage lifted, so that the toy vehicle can move. An object of the invention is to provide such a spring drive so that the spring blockage is maintained after the driving spring has been tensioned and it is released only after the vehicle has been nudged in either direction of movement whereby the driving spring unwinding and the resulting vehicle movement are initiated.

SUMMARY OF THE INVENTION

For achieving this object, a spring drive of the type and characteristics described herein is provided. More particularly, there is provided an engaging lever, which loosely holds a reverse pinion axle and thereby the reverse pinion in its in-mesh position, thereby blocking the driving spring. The engaging lever is carried on a reverse pinion axle and a spring drive platen in such a way that it is unlatched when the wind down/wind up shaft is wound in the direction corresponding to the motion direction of the toy vehicle, which in turn enables the unwinding of the spring drive mechanism.

A perferred embodiment of the present invention is described in detail herein below in conjunction with the drawings, and is set forth in the claims.

DESCRIPTION OF THE PREFERRED EMBODIMENT

Figure 1:
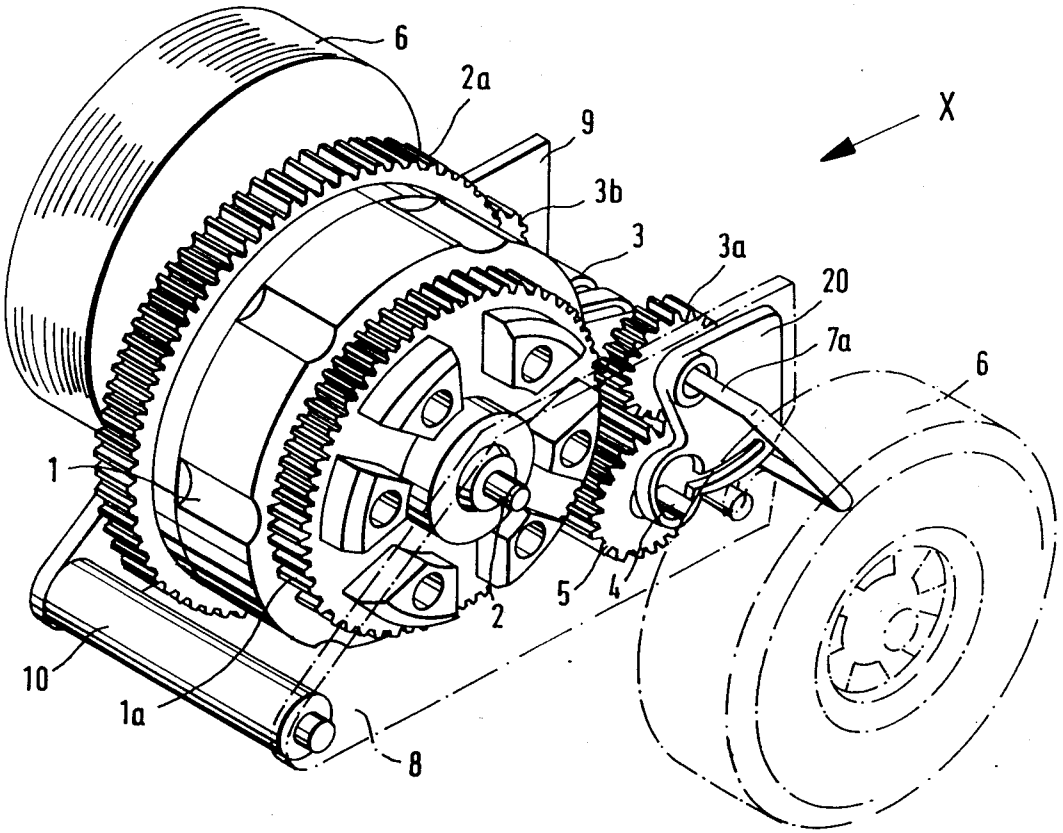
FIG. 1 is a perspective view of the spring drive mechanism of the present invention, with vehicle wheels and drive platen in phantom.

A spring drive transmission mechanism in accordance with the present invention is shown in FIG. 1; it is particularly useful in a toy car.

The spring drive transmission mechanism can be rotated within limits about a connecting rod 10 which mounts it in a toy vehicle chassis (not shown) in order to shift the wheels from a first position in which the vehicle wheels are driven by the unwinding spring into a second position in which the driving spring is wound by turning the vehicle wheels in either direction.

The driving spring, which may be a coil spring, is located in an encasement 1 which is provided with a first gear 1*a*. A second, larger spring gear 2*a* is rotatable relative to encasement 1 and is connected to the spring shaft 2. The interior end of the driving spring is connected to the spring shaft 2 and the exterior end to the spring encasement 1.

Drive pinions 5 and 5' (see FIG. 3) on the wind down/wind up shaft 4 mesh with the spring gears 1*a* and 2*a*. Unidirectional torque transmitters of opposite directions are located between the pinions 5 and 5' and the wind down/wind up shaft 4. Such torque transmitters are well known: see, for example, Darda U.S. Pat. No. 3,812,933. With torque transmitters, torques produced at the wind down/wind up shaft 4 are transferred, depending upon the direction of turning, either to the first spring gear 1*a* or to the second spring gear 2*a*. This construction results in the fact that the driving spring is simultaneously tensioned from both ends, regardless of the direction in which the wind down/wind up shaft 4 is turned. The vehicle wheels 6 are on the wind down/wind up shaft 4. Furthermore, a reverse pinion 3 is provided, including a first reverse pinion sprocket 3*b*, which is only partially visible, which is constantly in mesh with the second spring gear 2*a*; the second reverse pinion sprocket 3*a* is not engaged with pinion 5 in the positions shown in FIGS. 1 to 6. When the reverse pinion axle 7*a* is pressed down, the transmission, including reverse pionion sprocket 3*a*, is put in gear with the drive pinion 5. With this construction, the position of the transmission is achieved in which the driving spring can be wound in both directions by turning the vehicle wheels 6. E.g., if the vehicle wheels 6 are turned clockwise, that is if the vehicle with the reverse pinion axle 7*a* pressed down is pushed counter the forward direction X, then the drive pinion 5 drives the first spring gear 1*a* counterclockwise because of the unidirectional torque transmitter (which is not visible in the drawing). By means of the first spring gear 1*a*, the driving spring is tensioned from its external end. The turning movement of the drive pinion 5 is simultaneously reversed by means of the reverse pinion 3, the second reverse pinion sprocket 3*a* which is in mesh with the drive pinion 5 and the first reverse pinion sprocket 3*b* which is in mesh with the second spring gear 2*a*, and is transmitted to the latter so that the driving spring is simultaneously tensioned from its interior end since the interior end of the driving spring is connected to the spring gear 2*a*. Upon winding the vehicle wheels 6 counterclockwise, that is by pushing the driving mechanism in direction X, the pinion 5' is driven by the wind down/wind up shaft 4 whereas the drive pinion 5 spins opposite the wind down/wind up shaft 4 so that reverse functions result and, similarly as was previously mentioned, the spring gears 1*a* and 2*a* rotate in the same direction.

All shafts of the spring drive mechanisms are positioned between the two drive platens 8 and 9 which are connected to each other by means of connecting rods 10 and 11.

The reverse pinion axle 7*a* of the reverse pinion 3 is part of a bent spring wire (see FIG. 3) having other sections, namely the connecting bight 7*b*, the spring shank 7*c*, the spring coil 7*d*, and another spring shank 7*e*.

In accordance with the present invention, an engaging lever 20 is provided on the outside of platen 8, and holds the reverse pinion 3 against the effect of the reset force produced by the spring shanks 7*c*, 7*e* in mesh with the drive pinion 5. In this gear position, the transmission is blocked in such a way that the tensioned driving spring, located within the spring encasement 1, cannot release transmitter are because of the unidirectional torque which located within the pinions 5, 5' on the wind down/wind up shaft 4. As described below in detail the engaging lever 20 and notches forming parts of it are such that the engagement is released when the vehicle wheels 6 are turned counterclockwise. If a toy possessing the spring drive of the present construction is nudged in the direction of arrow X, for example, manually or by means of a second vehicle running into it, then consequentially the engagement is released so that the nudged vehicle can then go in motion under the influence of its own tensioned driving spring, as described below.

In FIGS. 2 to 7, only those portions of the present invention construction are described which are necessary for understanding the structure and functicns thereof.

Figure 2:
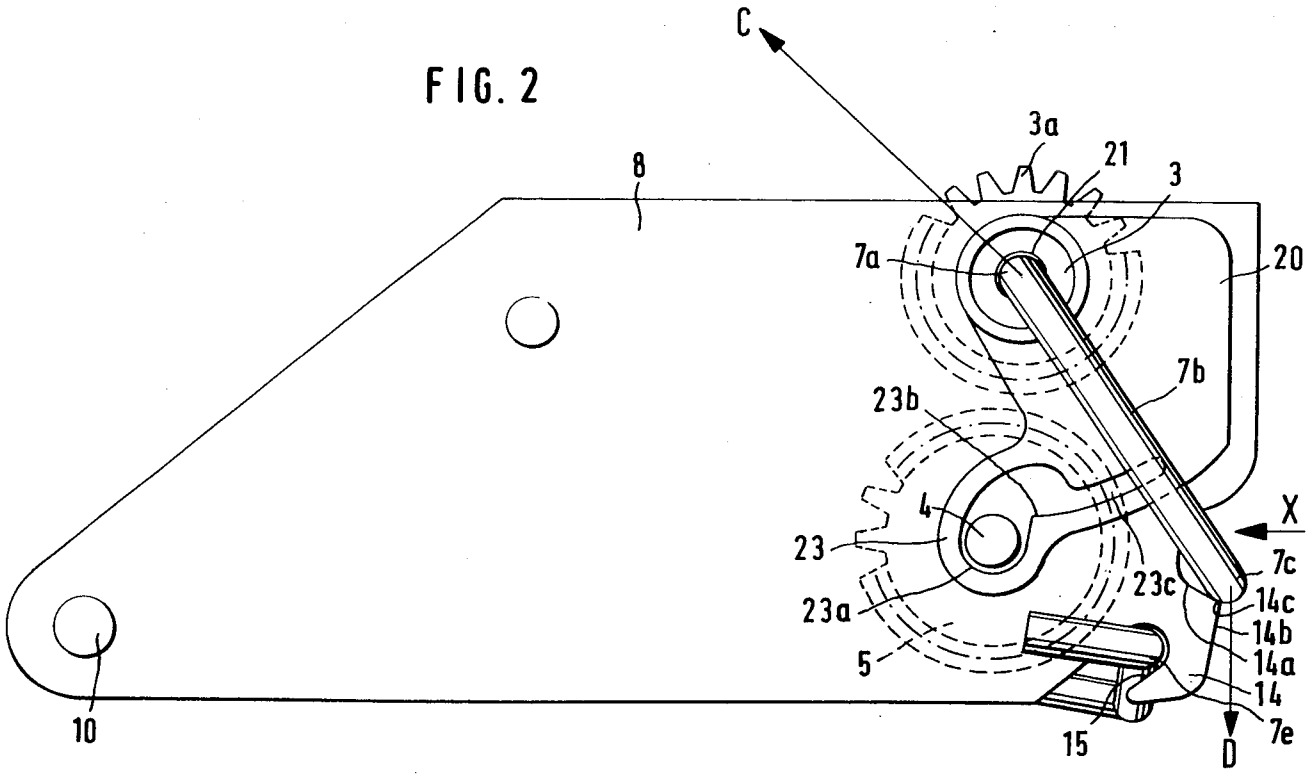
FIG. 2 is a side view of the spring drive mechanism of FIG. 1 with spring encasement omitted and spring shaft in the position allowing for unwinding of the spring drive mechanism.

FIG. 2 shows a side view of the spring drive mechanism in accordance with FIG. 1, in which the vehicle wheels 6, the spring encasement 1 with its first spring gear 1*a*, and the spring shaft 2 with its single-piece second spring gear 2*a* are omitted. For clarity, the first reverse pinion sprocket 3*a* of the reverse pinion 3 and the drive pinion 5 are depicted in the side view. These parts, in accordance with the depiction in FIG. 1, are positioned behind the drive platen 8.

The engaging lever 20 is journalled on the end of the reverse pinion axle 7*a* in front of the drive platen 8 and can be rotated on its socket 21. The spring wire 7*b* to 7*e* is constructed so that a reset force takes effect upon the end of the reverse pinion axle 7*a* in the direction of arrow C.

The engaging lever 20 surrounds the end of the wind down/wind up shaft 4 extending out of the drive platen 8 by means of the engaging lever eyelet 23. The wind down/wind up shaft 4 is in the lower notch 23*a* of the engaging lever eyelet 23 in the unengaged position. An upper nctch 23*b* is staggered in relation to the lower notch 23*a* within the engaging lever eyelet 23. The lever 20 adjacent the upper notch 23*b* is slightly flexible because of a narrow extension 23*c* of the engaging lever 20; lever 20 is made of spring elastic plastic.

Figure 3:
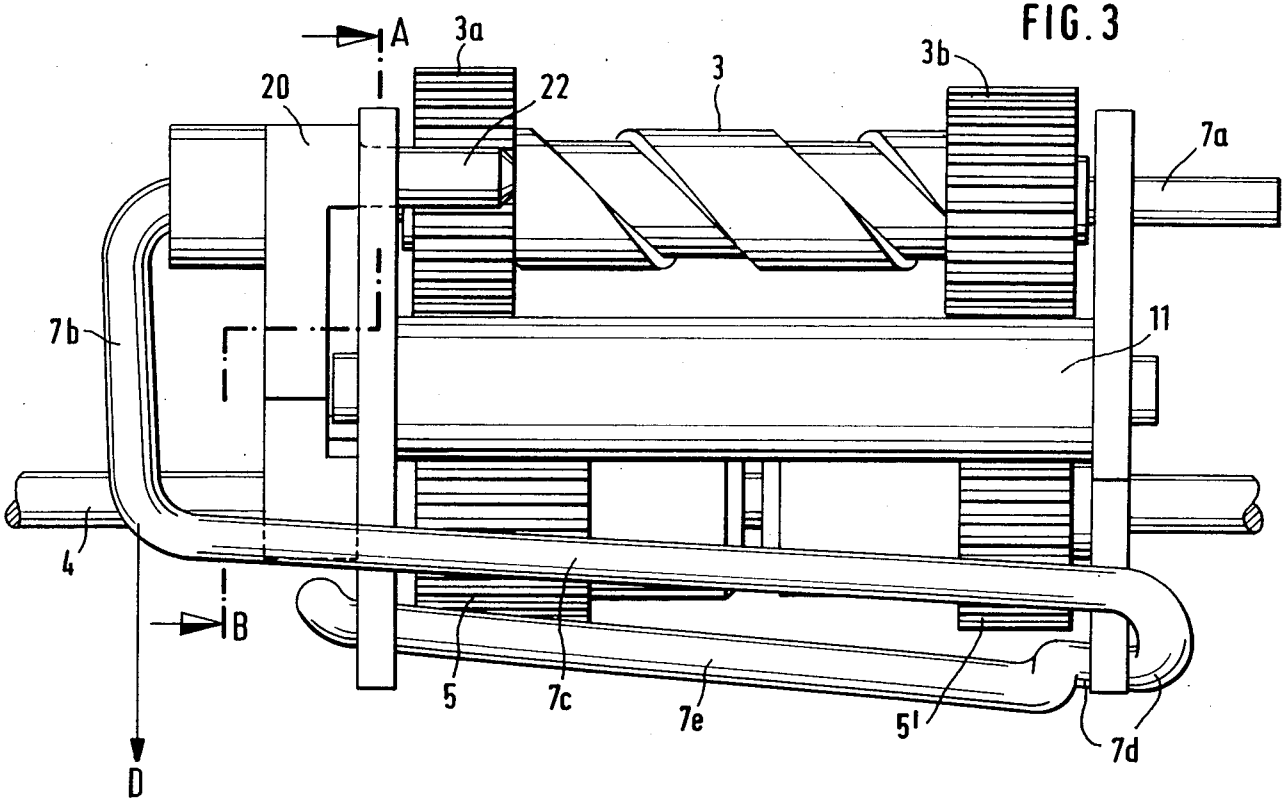
FIG. 3 is an end view of the transmission in accordance with FIG. 2 viewed in the direction of arrow X.
Figure 4:
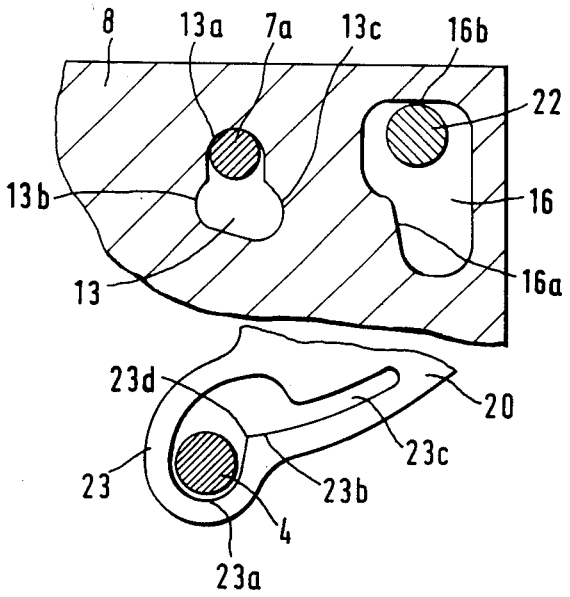
FIG. 4 is a cross-sectional view taken along the line A–B in FIG. 3.
Figure 6:
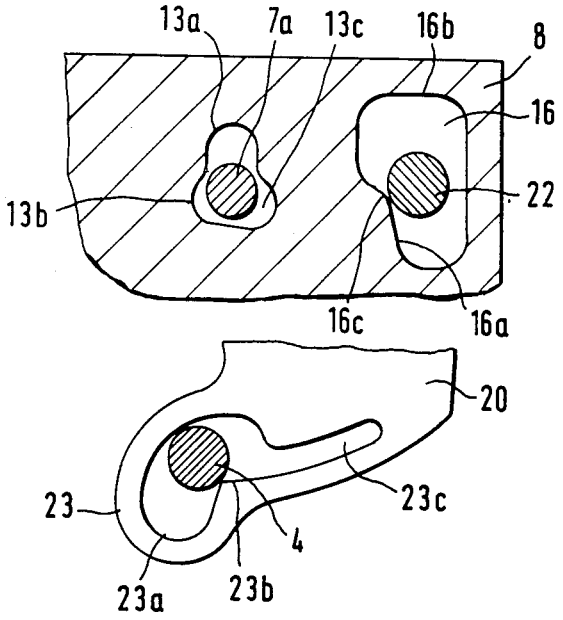
FIG. 6 is a cross-sectional view as in FIG. 4, with the parts in transition position as shown in FIG. 5, FIG. 7 a view similar to FIG. 2, with parts in position wherein the driving spring is blocked, FIG. 8 end view of the transmission in accordance with FIG. 7, viewed in the direction of arrow X.
Figure 9:
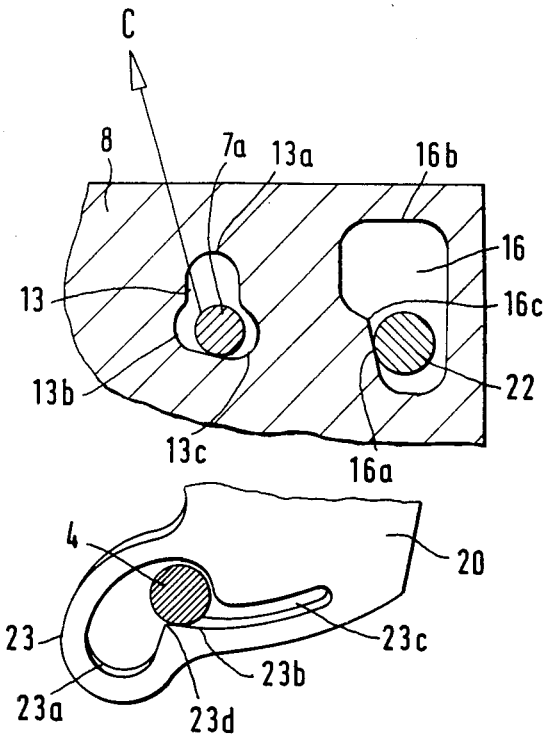
FIG. 9 is a detailed cross-sectional view taken along the A–B line of FIG. 8.

The view from the rear provided by FIG. 3, shows that the engaging lever 20 also has a bolt 22 extending from it: bolt 22 passes through an elongated opening 16 in the drive platen 8 as is shown in FIGS. 4, 6 and 9. In these Figures, the bearings of the reverse pinion axle 7*a* within the elongated opening 13 with its notches (13*a*, 13*b*, 13*c*) can be clearly seen.

The depictions in FIGS. 1 to 4 depict the spring drive mechanism and the significant parts thereof in the position in which an unwinding of the drive mechanism is possible, that is, where the driving spring is not blocked. As FIGS. 1 and 2 indicate, the first reverse pinion sprocket 3*a* is not in mesh with the drive pinion 5. In this position, the reverse pinion axle 7*a* is in the upper bearing notch 13*a* of the elongated opening 13; the bolt 22 of the engaging lever 20 is at the upper notch bearing surface 16*b* of the elongated opening 16 and the wind down/wind up shaft 4 is in the lower nótch 23*a* of the engaging lever eyelet 23.

Figure 5:
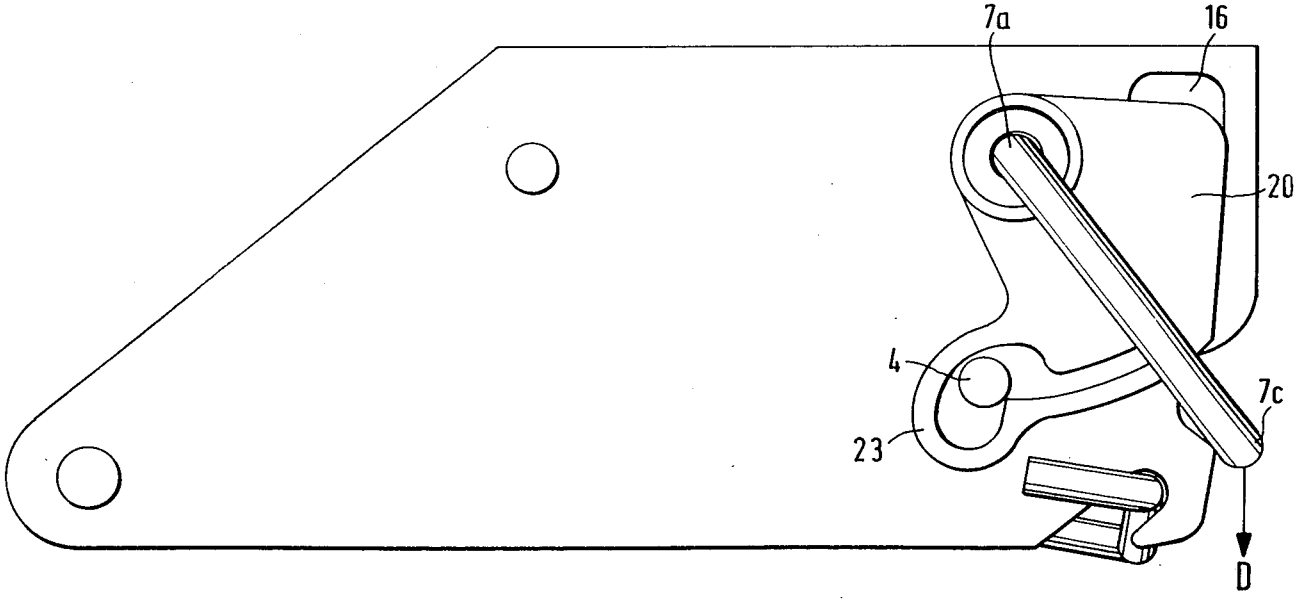
FIG. 5 is a view similar to FIG. 2, with the parts in a central transition position.
Figure 7:
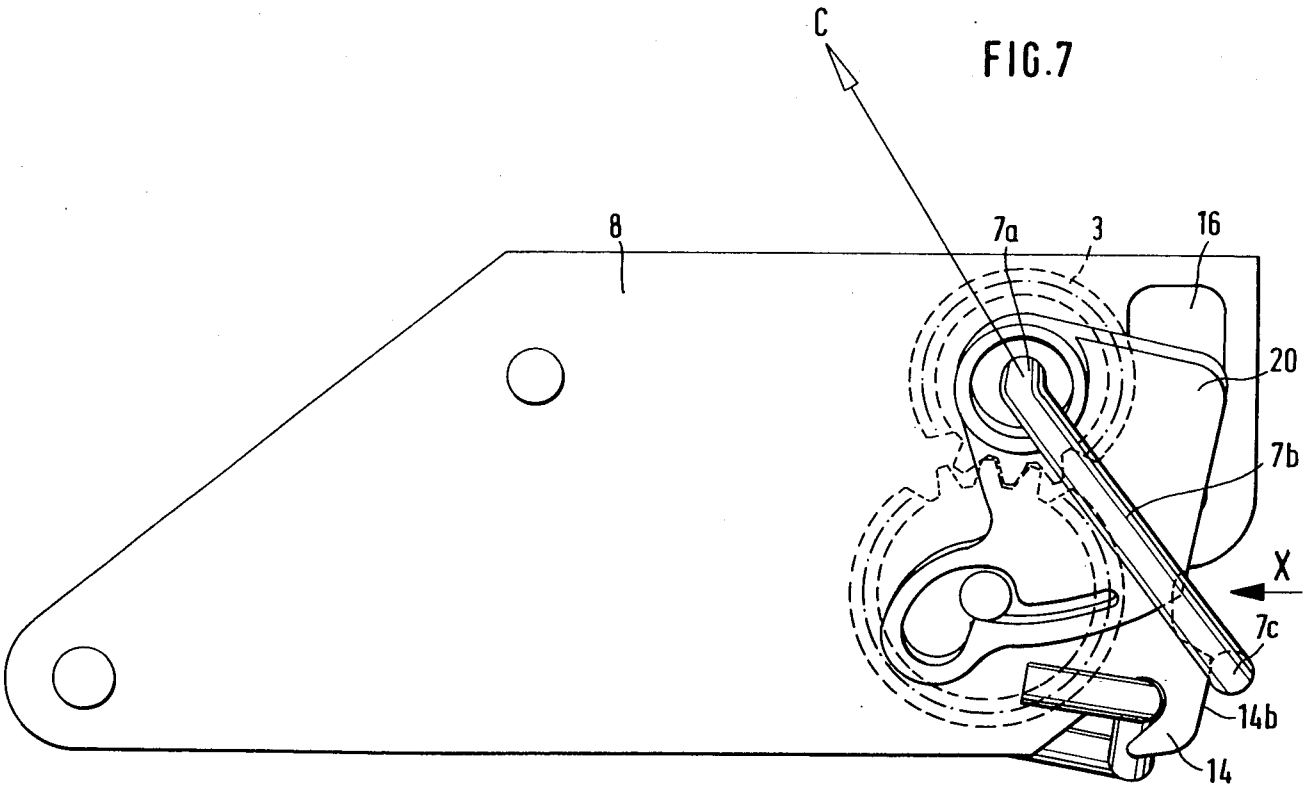
Figure 8:
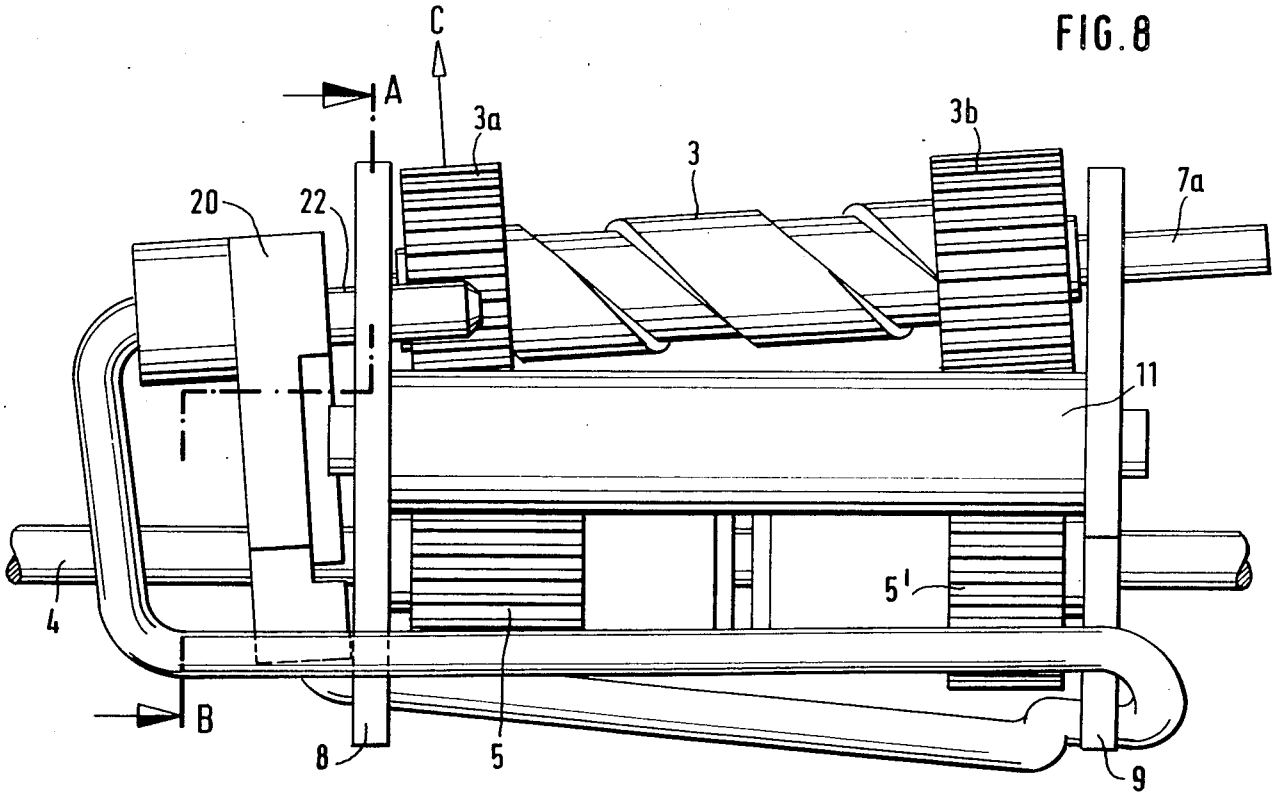

The first reverse pinion sprocket 3*a* is to be brought into mesh with the drive pinion 5 for blocking the driving spring and is to be held there as in shown in detail in Figs. 7 to 9, whereas FIGS. 5 and 6 show the transition position.

For the purpose of winding up the driving spring, a force is applied to the spring shank 7*c* by the chassis (not shown) in the direction of arrow D (see FIGS. 2, 3 and 5). The spring shank 7*c* (see FIG. 7) moves to the rear notch surface 14*b* of the C-frame part 14 of the drive platen 8 across the notch nose 14*c* from the bevel 14*a*. The result is that the reverse pinion axle 7*a* is pulled into a lower position from the upper notch 13*a* of the elongated opening 13 across the central neutral position shown in FIG. 5, which, as FIG. 9 indicates, is between the front notch 13*b* and the rear notch 13*c*. The engaging lever 20, which can be moved on the reverse pinion axle 7*a*, is necessarily moved as soon as its bolt 22 is guided from the upper notch surface 16*b* (see FIG. 4) across the notch nose 16*c* in the neutral position (see FIG. 6) to the lower notch surface 16*a* (see FIG. 9). Controlled by the motion of the reverse pinion axle 7*a* and of the bolt 22 within the elongated opening 16, the engaging lever 20 moves slightly in a clockwise direction so that the wind down/wind up shaft 4 is within the engaging lever eyelet 23 but is not in the lower notch 23*a*; it is in the upper notch 23*b*. The reverse pinion axle 7*a* is shifted to one of the notches 13*b*, 13*c* of the elongated opening 13 in such a way that when the reset spring power takes effect in direction of arrow C, the engaging lever 20 supported by the lower notch surface 16*a* by means of the bolt 22 remains in the position shown in FIGS. 7 to 9; that is, the wind down transmission remains blocked because of the reverse pinion 3. FIGS. 7 and 8 indicate that as a result the engaging lever 20 adopts a position which is slightly tilted with respect to the drive platen 8.

In order to transfer the drive mechanism out of the blocked position as depicted in FIGS. 7 to 9, into the unwinding position a counterclockwise torque should be placed on the wind down/wind up shaft 4 by turning the vehicle wheels 6. The gearing construction has the effect that the reverse pinion 3 is also shifted by a counterclockwise turning motion. This is possible because only the pinion 5' drives the second spring gear 2*a* in the clockwise direction by means of the now-activated directional locking gear and this drives the reverse pinion 3 in a counterclockwise direction by means of its second reverse pinion sprocket 3*b*. The drive pinion 5 can proceed opposite the turning direction of the wind down/wind up shaft 4 because the directional locking gear is released for this direction of movement. Therefore, the first spring gear 1*a* is turned counterclockwise via the first reverse pinion sprocket 3*a* and the drive pinion 5. The down shifting movement of the first reverse pinion sprocket 3*a* to the drive pinion 5 leads to a power component in the direction of arrow C, by means of which the engaging lever 20 is lifted in the same direction by means of the reverse pinion axle 7*a*. Controlled by the bolt 22 adjacent to the lower notch surface 16*a* to the notch nose 16*c*, a shifting motion of the engaging lever 20 in the counterclockwise direction is introduced. Because the engaging lever eyelet 23 near the upper notch 23*b*, which rests on the lower side of the stationary wind down/wind up shaft 4, is slightly flexible because of the narrow eyelet extension 23*c*, the engaging lever 20 can be moved into the initial position, as shown in FIGS. 1 to 4, across the notch nose 23*d*, in which initial position the lower notch 23*a* touches the wind down/wind up shaft 4.

Driving of the car will be effected with the parts in the position shown in FIGS. 1–4. Spring gear 2*a* is urged in one direction by the tension spring (not Shown). Spring gear 2*a* is in mesh with the drive pinion 5' and with the first reverse pinion sprocket 3*b*. Assuming that spring gear 2*a* is urged in a counter-clockwise direction as seen in FIG. 1, it will cause clockwise rotation of the reverse pinion sprocket 3*b* and of the drive pinion 5' (not shown in FIG. 1) to drive the wind-down-/wind-up shaft 4 in the clockwise direction. The motion of first reverse pinion sprocket 3*b* will be transferred through the reverse pinion 3 to the second reverse pinion sprocket 3*a*; since the second reverse pinion sprocket 3*a* is not in mesh with any gear, it will spin freely. The first gear 1*a* will be urged oppositely to the second gear 2*a*, which is in the clockwise direction as viewed in FIG. 1. This will urge drive pinion 5 to rotate in a counter-clockwise direction. Due to the unidirectional torque transmitters on the shaft 4, shaft 4 will be driven in only one direction, so that both of the wheels 6 are thereby driven in the same direction. As will be understood, if the spring has been wound in the opposite direction to that in the foregoing example, the first spring gear 1*a* and the second spring gear 2*a* will be urged in opposite directions to that described and will have the effect of rotating the wind-down/wind-up shaft 4 in the opposite direction.

We claim:

1. A spring drive for toy vehicles comprising:

a spring having each of its ends connected to first and second spring gears, a wind down/wind up shaft having unidirectional torque transmitters of opposite directions thereon, and drive pinions meshing with said spring gears for transferring torque of said shaft to one or the other of said spring gears, a reverse pinion having an axle and two reverse pinion sprockets thereon, one said reverse pinion sprocket being constantly in mesh with a first said drive pinion, means supporting said other reverse pinion sprocket for movement into and out of mesh with the other said drive pinion, said supporting means including a spring wire forming a reverse pinion axle, spaced drive platens, one said drive platen having an elongated opening, said reverse pinion axle supported in said drive platens and passing through said opening, an engaging lever pivotally supported on the reverse pinion axle adjacent the platen having the elongated opening and movable with the reverse pinion axle in said elongated opening, and means including said engagin lever for causing movement of said reverse pinion axle into a first position in which the reverse pinion sprockets engage said drive pinions and thereby block movement of the spring and into a second position in which a said reverse pinion sprocket is out of mesh with any drive pinion.

2. A spring drive as in claim 1, wherein said last-mentioned means further includes a pair of adjustment mechanisms for means said reverse pinion axle staggered in relation thereto.

3. The spring drive of claim 2, wherein said first adjustment mechanism comprises a second elongated opening in said platen and a bolt extending from said engaging lever through a second elongated opening in said platen; and said second adjustment mechanism comprises an elongated opening in said engaging lever, said wind down/wind up shaft extending through said last-mentioned opening, said engaging lever adjacent said opening therein being flexible and resilient.

4. A spring drive as in claim 3, said second opening in said platen having two notch surfaces, and the opening in said engaging lever having a first notch for causing the lever to position the first reverse pinion sprocket in mesh with a said drive pinion and a second notch to position the first reverse pinion sprocket out of mesh therewith.

5. A spring drive as in claim 4, wherein said reverse pinion axle is approximately parallel to said wind down-/wind up shaft.

6. A spring device as in claim 3, said engaging lever being of flexible plastic material and having a narrow extension of said opening.

7. A spring drive for toy vehicles comprising:

a spring having each of its ends connected to first and second spring gears, a wind down/wind up shaft having unidirectional torque transmitters of opposite directions thereon, and drive pinions meshing with said spring gears for transferring torque of said shaft to one or the other of said spring gears, a reverse pinion having an axle and two reverse pinion sprockets thereon, one said reverse pinion sprocket being constantly in mesh with a first said drive pinion, means for supporting said outer reverse pinion sprocket for movement into and out of mesh with other said drive pinion, said supporting means for said reverse pinion including a spring wire forming a reverse pinion axle, spaced drive platens, one said drive platen having an elongated opening, said reverse pinion axle supported in said drive platens and passing through said opening, means for moving said reverse pinion axle in said opening into a first position in which the reverse pinion sprockets engage said drive pinions and thereby block movement of the spring, and means responsive to rotatation of said wind down-/wind up shaft when said reverse axle is in said first position for moving said reverse pinion axle into a second position in which a said reverse pinion sprocket is out of mesh with any drive pinion.

8. The spring drive of claim 7, said means for moving said reverse pinion axle comprising an engaging lever pivotally supported on said reverse pinion axle adjacent said platen having the elongated opening therein, said wind down/wind up shaft extending through said elongated opening in said lever.

9. A spring drive for toy vehicles comprising: a spring having each of its ends connected to first and second spring gears, a wind down/wind up shaft having wheels thereon, transmission means for connecting said spring gears and said wind down/wind up shaft comprising gear means having a first position in which (i) said spring gears are caused to wind up said spring upon rotation of said wind down/wind up shaft and (ii) said spring gears are blocked from driving said wind down/wind up shaft, and a second position in which said spring causes one said spring gear to drive said wind down/wind up shaft, and means responsive to rotation of said wind down-/wind up shaft when said gear means is in said first position for releasing said tranmission means for said first blocked position and for shifting it into said second position for causing a said spring gear to drive said wind down/wind up shaft.

* * * * *